United States Patent [19]

Tanikawa et al.

[11] 4,329,416

[45] May 11, 1982

[54] METHODS FOR PREPARING PLURAL LAYER ORGANIC ELECTROPHOTOGRAPHIC ELEMENTS

[75] Inventors: Kiyoshi Tanikawa, Yokohama; Masao Yoshikawa, Machida; Tsutomu Sato, Kawasaki, all of Japan

[73] Assignee: Ricoh Co., Ltd., Tokyo, Japan

[21] Appl. No.: 183,919

[22] Filed: Sep. 4, 1980

[30] Foreign Application Priority Data

Sep. 12, 1979 [JP] Japan ..... 54/116164

[51] Int. Cl.[3] ..... G03G 5/07

[52] U.S. Cl. ..... 430/133; 430/134; 430/900; 430/66; 430/72; 430/74

[58] Field of Search ..... 430/129, 133, 900, 66, 430/72, 74

[56] References Cited

U.S. PATENT DOCUMENTS

| | | | |
|---|---|---|---|
| 3,684,548 | 8/1972 | Contois | 430/133 |
| 3,992,204 | 11/1976 | Taylor | 430/57 X |
| 4,173,473 | 11/1979 | Petropoulos et al. | 430/72 |
| 4,175,960 | 11/1979 | Berwick et al. | 430/74 X |

*Primary Examiner*—John D. Welsh

*Attorney, Agent, or Firm*—Blanchard, Flynn, Thiel, Boutell & Tanis

[57] ABSTRACT

A method for preparing an electrophotographic element wherein in the formation of a co-crystalline complex photosensitive layer a conducting substrate or another photosensitive layer is over-coated with a solution consisting essentially of a pyrylium dye and an electric insulating polymer and dried at least two times respectively.

15 Claims, 11 Drawing Figures

METHODS FOR PREPARING PLURAL LAYER ORGANIC ELECTROPHOTOGRAPHIC ELEMENTS

BACKGROUND OF THE INVENTION (a) Field of the Invention

This invention relates to methods for preparing electrophotographic elements and in particular to methods for preparing electrophotographic elements wherein co-crystalline complex photosensitive layers are subjected to more than two coating and drying steps so as to have an excellent photosensitivity.

(b) Description of the Prior Art

Electrophotographic elements comprising a conducting substrate and a photoconductive layer, superposed thereon, made of a co-crystalline complex consisting of a pyrylium dye and an electric insulating polymer have been proposed in patent specifications, for example, Belgian Pat. No. 705117, U.S. Pat. Nos. 3,533,786; 3,542,544 and others. And, U.S. Pat. No. 3,591,374 discloses a measure of overcoating a photosensitive layer with a pyrylium dye for the purpose of enhancing the sensitivity of said co-crystalline complex system electrophotographic element. However, there is a need for photoconductive elements of even higher electrophotographic speeds.

SUMMARY OF THE INVENTION

It is, therefore, an object of this invention to provide methods for preparing electrophotographic elements with co-crystalline complex photosensitive layers having exceedingly improved electrophotographic speeds.

It is another object of this invention to provide methods for preparing electrophotographic elements which can dispense with especially complicated operations.

We have carried out a series of detailed investigations into co-crystalline complex photosensitive layers. We have confirmed that these layers, which are normally formed by a single coating step using a doctor blade and which have a thickness of 20–30 μm or more, are liable to the occurrence of uneven coatings, concentration variations and the like on the surfaces of the co-crystalline complex photosensitive layers. Eventually the superficial roughness exerts a bad influence on the image characteristics. In addition, we have discovered that when the film thickness of the co-crystalline complex photosensitive layer is increased by means of a single coating step using a doctor blade, there takes place a tendency that the sensitivity is deteriorated. Still further, we have confirmed that when the co-crystalline complex photosensitive layer is formed by two or more overcoatings of a co-crystalline complex photosensitive solution in such a manner that said solution is first coated, for instance, in a thickness of about 12 μm and dried and then the same solution is again overcoated thereon in a thickness of about 12 μm, there is observed no deterioration in the sensitivity and a photosensitive element having improved image characteristics can be produced without changing the surface property of the photosensitive layer. This invention has been completed on the basis of the aforesaid confirmed results.

Accordingly, the method for preparing an electrophotographic element according to this invention is characterized in that for the purpose of forming a co-crystalline complex photosensitive layer by overcoating a conducting substrate or another photosensitive layer with a solution consisting essentially of a pyrylium dye and an electric insulating polymer (namely, a co-crystalline complex solution) and drying, said co-crystalline complex photosensitive layer is formed by applying at least two overcoats, namely, at least two steps of coating said co-crystalline complex solution and drying.

DETAILED DESCRIPTION OF THE INVENTION

Figure 3:
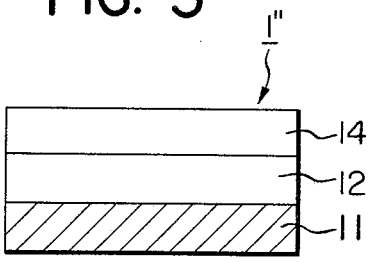
Figure 4:
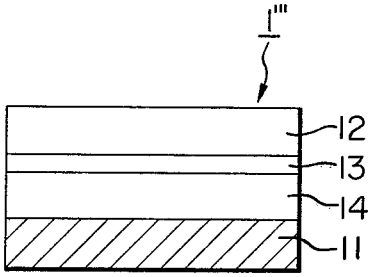
Figure 5:
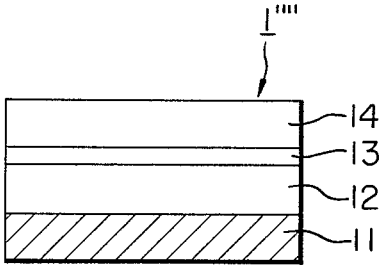
Figure 6A:
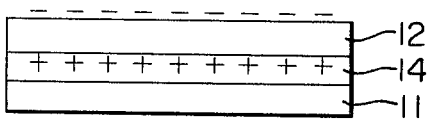
FIGS. 6 through 11 are views illustrating electrophotography procedures utilizing therein the so-called composite photosensitive elements shown in FIGS. 2 through 5 of aforesaid Figures in FIGS. 6 through 11, the composite photosensitive element as shown in FIG. 2 was selected by way of example. In these Figures, 1, 1', 1'', 1''' and 1'''' denote electrophotographic elements, 11 denotes a conducting substrate, 12 denotes a co-crystalline complex photosensitive layer (which is employable as a second photoconductive layer as well as a co-crystalline complex photosensitive layer in the cases of FIGS. 2 and 4), 13 denotes an intermediate layer, and 14 denotes a photosensitive layer other than the co-crystalline complex photosensitive layer (which is a first photoconductive layer in the cases of FIGS. 2 and 4). In this context, it is to be noted that the "first photoconductive layer" and "second photoconductive layer" referred to in the composite photosensitive elements illustrated in FIGS. 2 through 5 (1', 1'', 1''' and 1'''') denote a lower part photosensitive layer and an upper part photosensitive layer respectively.
Figure 6B:
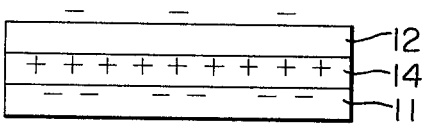
Figure 6C:
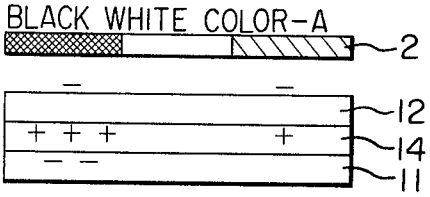
Figure 6D:
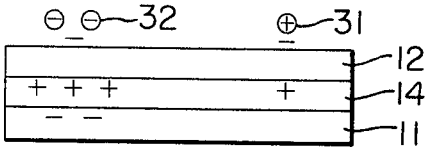

The method for preparing the photosensitive element according to this invention will be explained in more detail with reference to the attached drawings. As previously described, FIGS. 1 through 5 illustrate examples of photosensitive elements produced by practicing the present method, wherein FIG. 1 denotes the so-called mono-layer type photosensitive element (1), and FIGS. 2 and 4 denote the so-called multilayer type composite photosensitive elements (1' or 1''') comprising a conducting substrate 11, a photoconductive layer 14 other than a co-crystalline complex photosensitive layer, superposed on said substrate, said layer 14 being provided as the first conductive layer, and a co-crystalline complex photosensitive layer 12 provided as the second photoconductive layer, with or without the aid of an intermediate layer 13. FIGS. 3 and 5 denote multilayer type composite photosensitive elements (1'' or 1'''') wherein the positional relationship illustrated in FIGS. 2 and 4 is reversed.

The conducting substrates 11 suitably used in this invention include those having an electric conductivity less than $10^{10}$ Ωcm, for instance, such as metal plates like Al, Cu, Pb and the like; plates comprising metal oxides like $SnO_2$, $In_2O_3$, CuI, $CrO_2$ and the like; or plastic films (for instance, polyester film) paper, cloth and the like whose surface has been coated with those metals or metal oxides by evaporation or sputtering.

As stated previously, the co-crystalline complex layers 12 are made of pyrylium dyes (pyrylium, thiapyrylium, selenapyrylium and the like) and an electric insulating polymer (electric insulating resins containing alkylidenediarylene moieties).

Pyrylium dyes usable herein are those having the following general formula:

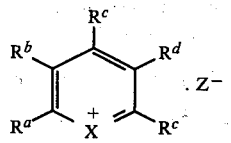

wherein $R^a$, $R^b$, $R^c$, $R^d$ and $R^e$ can each represent (a) a hydrogen atom (b) alkyl groups typically having from 1 to 15 carbon atoms such as methyl, ethyl, propyl, isopropyl, butyl, t-butyl, amyl, isoamyl, hexyl, octyl, nonyl, dodecyl and the like;

(c) alkoxy groups such as methoxy, ethoxy, propoxy, butoxy, amyloxy, hexoxy, octoxy and the like;

(d) alkylphenyls such as phenyl, 4-diphenyl, 4-ethylphenyl, 4-propylphenyl and the like; alkoxyphenyls such as 4-ethoxyphenyl, 4-methoxyphenyl, 4-amyloxyphenyl, 2-hexoxyphenyl, 2-methoxyphenyl, 3,4-dimethoxyphenyl and the like; β-hydroxyalkoxyphenyls such as 2-hydroxyethoxyphenyl, 3-hydroxyethoxyphenyl and the like, halophenyls such as 4-hydroxyphenyl, 2,4-dichlorophenyl, 3,4-dibromophenyl, 4-chlorophenyl, 3,4-dichlorophenyl and the like; aminophenyls such as azidophenyl, nitrophenyl, 4-diethylaminophenyl, 4-dimethylaminophenyl and the like; aryl groups, including substituted aryl groups such as vinyl-substituted aryl groups of naphthyl, styryl, methoxystyryl, diethoxystyryl, dimethylaminostyryl, 1-butyl-4-p-dimethylaminophenyl-1,3-butadienyl, β-ethyl-4-dimethylaminostyryl and the like; and where X is a sulfur, oxygen or selenium atom and $Z^-$ is an anionic function such as perchlorate, fluoroborate, iodide, chloride, bromide, sulfate, periodate, p-toluenesulfonate, hexafluorophosphate and the like. In addition, $R^a$, $R^b$, $R^c$, $R^d$ and $R^e$ can together be the necessary atoms to complete an aryl ring fused to the pyrylium nucleus. Typical members of such pyrylium dyes are listed hereinafter.

| Compound No. | Name of compound |
|---|---|
| 1 | 4-[4-bis-(2-chloroethyl)aminophenyl]-2,6-diphenylthiapyrylium perchlorate |
| 2 | 4-(4-dimethylaminophenyl)-2,6-diphenylthiapyrylium perchlorate |
| 3 | 4-(4-dimethylaminophenyl)-2,6-diphenylthiapyrylium-fluoroborate |
| 4 | 4-(4-dimethylamino-2-methylphenyl)-2,6-diphenylpyrylium perchlorate |
| 5 | 4-[4-bis(2-chloroethyl)aminophenyl]-2-(4-methoxyphenyl)-6-phenylthiapyrylium perchlorate |
| 6 | 4-(4-dimethylaminophenyl)-2,6-diphenylthiapyrylium sulfate |
| 7 | 4-(4-dimethylaminophenyl)-2,6-diphenylthiapyrylium-p-toluene sulfonate |
| 8 | 4-(4-dimethylaminophenyl)-2,6-diphenylpyrylium-p-toluene sulfonate |
| 9 | 2-(2,4-dimethoxyphenyl)-4-(4-dimethylaminophenyl)-benzo[b]-pyrylium perchlorate |
| 10 | 2,6-bis(4-ethylphenyl)-4-(4-dimethylaminophenyl)-thiapyrylium perchlorate |
| 11 | 4-(4-dimethylaminophenyl)-2-(4-methoxyphenyl)-6-phenylthiapyrylium perchlorate |
| 12 | 4-(4-dimethylaminophenyl)-2-(4-ethoxyphenyl)-6-phenylthiapyrylium perchlorate |
| 13 | 4-(4-diethylaminophenyl)-2-(4-methoxyphenyl)-6-(4-methylphenyl)-pyrylium perchlorate |

-continued

| Compound No. | Name of compound |
|---|---|
| 14 | 4-(4-diphenylaminophenyl)-2,6-diphenylthiapyrylium perchlorate |
| 15 | 2,4,6-triphenylpyrylium perchlorate |
| 16 | 4-(4-methoxyphenyl)-2,6-diphenylpyrylium perchlorate |
| 17 | 4-(2,4-dichlorophenyl)-2,6-diphenylpyrylium perchlorate |
| 18 | 4-(3,4-dichlorophenyl)-2,6-diphenylpyrylium perchlorate |
| 19 | 2,6-bis(4-methoxyphenyl)-4-phenylpyrylium perchlorate |
| 20 | 6-(4-methoxyphenyl)-2,4-diphenylpyrylium perchlorate |
| 21 | 2-(3,4-dichlorophenyl)-4-(4-methoxyphenyl)-6-phenylpyrylium perchlorate |
| 22 | 4-(4-amyloxyphenyl)-2,6-bis(4-ethylphenyl)pyrylium perchlorate |
| 23 | 4-(4-amyloxyphenyl)-2,6-bis(4-methoxyphenyl)pyrylium perchlorate |
| 24 | 2,4,6-triphenylpyrylium fluoroborate |
| 25 | 2,6-bis(4-ethylphenyl)-4-(4-methoxyphenyl)pyrylium perchlorate |
| 26 | 2,6-bis(4-ethylphenyl)-4-(4-methoxyphenyl)pyrylium fluoroborate |
| 27 | 6-(3,4-diethoxystyryl)-2,4-diphenylpyrylium perchlorate |
| 28 | 6-(3,4-diethoxy-β-amylstyryl)-2,4-diphenylpyrylium fluoroborate |
| 29 | 6-(4-dimethylamino-β-ethylstyryl)-2,4-diphenylpyrylium fluoroborate |
| 30 | 6-(1-n-amyl-4-p-dimethylaminophenyl-1,3-butadienyl)-2,4-diphenylpyrylium fluoroborate |
| 31 | 6-(4-diethylaminostyryl)-2,4-diphenylpyrylium fluoroborate |
| 32 | 6-[d-ethyl-β,β-bis(dimethylaminophenyl)vinylene]-2,4-diphenylpyrylium fluoroborate |
| 33 | 6-(1-butyl-4-p-dimethylaminophenyl-1,3-butadienyl)-2,4-diphenylpyrylium fluoroborate |
| 34 | 6-(4-dimethylaminostyryl)-2,4-diphenylpyrylium perchlorate |
| 35 | 6-[β,β-bis(4-dimethylaminophenyl)vinylene]-2,4-diphenylpyrylium perchlorate |
| 36 | 2,6-bis(4-dimethylaminostyryl)-4-phenylpyrylium perchlorate |
| 37 | 6-(β-methyl-4-dimethylaminostyryl)-2,4-diphenylpyrylium fluoroborate |
| 38 | 2-(4-ethylphenyl)-4,6-diphenylthiapyrylium perchlorate |
| 39 | 2,6-diphenyl-4-(4-methoxyphenyl)thiapyrylium perchlorate |
| 40 | 2,6-diphenyl-4-(4-methoxyphenyl)thiapyrylium fluoroborate |
| 41 | 2,6-bis(4-ethylphenyl)-4-(4-n-amyloxyphenyl)-thiapyrylium perchlorate |
| 42 | 2,6-bis(4-methoxyphenyl)-4-(4-n-amyloxyphenyl)-thiapyrylium perchlorate |
| 43 | 2,4,6-tris(4-methoxyphenyl)thiapyrylium fluoroborate |
| 44 | 2,4-diphenyl-6-(3,4-diethoxystyryl)pyrylium perchlorate |
| 45 | 4-(4-dimethylaminophenyl)-2-phenylbenzo[b]-selenapyrylium perchlorate |
| 46 | 2-(2,4-dimethoxyphenyl)-4-(4-dimethylaminophenyl)-benzo[b]selenapyrylium perchlorate |
| 47 | 4-(4-dimethylaminophenyl)-2,6-diphenylselenapyrylium perchlorate |
| 48 | 4-(4-dimethylaminophenyl)-2-(4-ethoxyphenyl)-6-phenylselenapyrylium perchlorate |
| 49 | 4-[4-bis(2-chloroethyl)aminophenyl]-2,6-diphenylselenapyrylium perchlorate |
| 50 | 4-(4-dimethylaminophenyl)-2,6-bis(4-ethylphenyl)-2,6-bis(4-ethylphenyl)selenapyrylium perchlorate |
| 51 | 4-(4-dimethylamino-2-methylphenyl)-2,6-diphenylselenapyrylium perchlorate |
| 52 | 3-(4-dimethylaminophenyl)naphtho[2,1-b]selenapyrylium perchlorate |
| 53 | 4-(4-dimethylaminostyryl)-2-(4-methoxyphenyl)benzo[b]-selenapyrylium perchlorate |
| 54 | 2,6-di(4-diethylaminophenyl)-4-phenylselenapyrylium perchlorate |
| 55 | 4-(4-dimethylaminophenyl)-2-(4-ethoxyphenyl)-6-phenylthiapyrylium fluoroborate |
| 56 | 4-benzylamino-2-phenylbenzo[b]pyrylium perchlorate |
| 57 | 4-anilino-2-(4-methoxyphenyl)naphtho(1,2-b)pyrylium |

-continued

| Compound No. | Name of compound |
|---|---|
| | perchlorate |
| 58 | 4-(N-butylamino)-2-phenylbenzo[b]thiapyrylium perchlorate |
| 59 | 4-(N-butylamino)-2-(p-methoxyphenyl)benzo[b]pyrylium perchlorate |
| 60 | 4-(4-dimethylaminophenyl)-2-(4-ethoxyphenyl)-6-phenylthiapyrylium fluoroborate |
| 61 | 4-(4-dimethylaminophenyl)-2,6-diphenylthiapyrylium hexafluorophosphate |

Particularly useful pyrylium dyes are those having the following general formula:

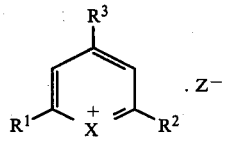

wherein:

$R^1$ and $R^2$ can each be aryl radicals such as substituted phenyl radicals having at least one substituent chosen from alkyl radicals having from 1 to 6 carbon atoms and alkoxy radicals having from 1 to 6 carbon atoms.

$R^3$ may be alkylamino-substituted phenyl radicals of from 1 to 6 carbon atoms in the alkyl moiety, including a dialkylamino or halogenated alkylamino-substituted phenyl radical of from 1 to 6 carbon atoms.

X is an oxygen or sulfur atom. $Z^-$ is the same as above.

Particularly useful electric insulating polymers are those having alkylidenediarylene moieties represented by the following formula in the main chain (recurring unit):

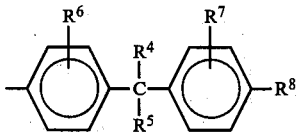

wherein:

$R^4$ and $R^5$, when taken separately, can each represent a hydrogen atom, an alkyl radical such as methyl, ethyl, propyl, isopropyl, butyl, tertiary butyl, pentyl, hexyl, heptyl, octyl, nonyl, decyl and the like including substituted alkyl radicals such as trifluoromethyl, etc., and an aryl radical such as phenyl and naphthyl including substituted aryl radicals having such substituents as halogen, alkyl radicals of from 1 to 5 carbon atoms, etc.; and $R^4$ and $R^5$, when taken together, can represent the carbon atoms necessary to form a cyclic hydrocarbon radical including cycloalkanes such as cyclohexyl and polycycloalkanes such as norbornyl.

$R^6$ and $R^7$ can each be hydrogen, an alkyl radical of from 1 to 6 carbon atoms or a halogen such as chloro, bromo, iodo, etc., and $R^8$ is a divalent radical selected from the group consisting of

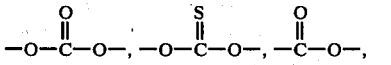

-continued

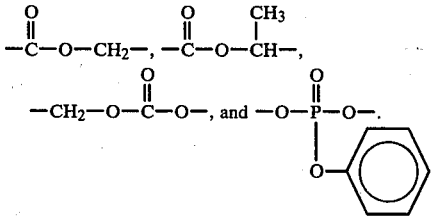

In addition, hydrophobic carbonate polymers (polycarbonates) comprised of the following recurring unit are useful and preferable:

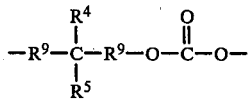

wherein:

$R^9$ is a phenylene radical including halo substituted phenylene radicals and alkyl substituted phenylene radicals; and $R^4$ and $R^5$ are described above. Such compositions are disclosed, for example, in U.S. Pat. Nos. 3,028,365 and 3,317,466. Preferably polycarbonates containing, in the recurring unit, alkylidenediarylene moieties such as those prepared with Bisphenol A and including polymeric products of ester exchange between diphenylcarbonate and 2,2-bis(4-hydroxyphenyl)propane are useful in the practice of this invention. Such compositions are disclosed in the specifications of the following U.S. Pat. Nos. 2,999,750; 3,038,874; 3,038,880; 3,106,544; 3,106,545; 3,106,546; and so forth. At any rate, film-forming polycarbonate resins are of wide range applicabilities. The use of those having an intrinsic viscosity of from about 0.5 to about 1.8 can attain especially satisfactory results.

Representative electric insulating polymers are set out hereinafter.

| No. | Polymeric material |
|---|---|
| 1 | poly(4,4'-isopropylidenediphenylene-co-1,4-cyclohexylidimethyl carbonate) |
| 2 | poly(3,3'-ethylenedioxyphenylene thiocarbonate) |
| 3 | poly(4,4'-isopropylidenediphenylene carbonate-co-terephthalate) |
| 4 | poly(4,4'-isopropylidenediphenylene carbonate) |
| 5 | poly(4,4'-isopropylidenephenylene thiocarbonate) |
| 6 | poly(2,2-butane bis-4-phenylene carbonate) |
| 7 | poly(4,4'-isopropylidenediphenylene carbonate-block-ethylene oxide) |
| 8 | poly(4,4'-isopropylidenediphenylene carbonate-block-tetramethylene oxide) |
| 9 | poly[4,4'-isopropylidene bis(2-methylphenylene) carbonate] |
| 10 | poly(4,4'-isopropylidenephenylene-co-1,4-phenylene carbonate) |
| 11 | poly(4,4'-isopropylidenediphenylene-co-1,3-phenylene carbonate) |
| 12 | poly(4,4'-isopropylidenediphenylene-co-4,4'-diphenylene carbonate) |
| 13 | poly(4,4'-isopropylidenediphenylene-co-4,4'-oxydiphenylene carbonate) |
| 14 | poly(4,4'-isopropylidenediphenylene-co-4,4'-carbonyldiphenylene carbonate) |
| 15 | poly(4,4'-isopropylidenediphenylene-co-4,4'-ethylenediphenylene carbonate) |
| 16 | poly[4,4'-methylene bis(2-methylphenylene)carbonate] |
| 17 | poly[1,1-(p-bromophenylethane)-bis(4-phenylene)carbonate] |
| 18 | poly[4,4'-isopropylidenediphenylene-co-sulfonyl-bis(4-phenylene)carbonate] |
| 19 | poly[1,1-cyclohexane bis(4-phenylene)carbonate] |

-continued

| No. | Polymeric material |
|---|---|
| 20 | poly[4,4'-isopropylidene bis(2-chlorophenylene)carbonate] |
| 21 | poly(hexafluoroisopropylidene di-4-phenylene carbonate) |
| 22 | poly(4,4'-isopropylidenediphenylene-4,4'-isopropylidene dibenzoate) |
| 23 | poly(4,4'-isopropylidenedibenzyl-4,4'-isopropylidene dibenzoate) |
| 24 | poly[2,2-(3-methyl butane)bis-4-phenylene carbonate] |
| 25 | poly[2,2-(3,3-dimethyl butane)bis-4-phenylene carbonate] |
| 26 | poly{1,1-[1-(1-naphthyl)]bis-4-phenylene carbonate} |
| 27 | poly[2,2-(4-methyl pentane)bis-4-phenylene carbonate] |
| 28 | poly[4,4'-(2-norbornylidene)diphenylene carbonate] |
| 29 | poly[4,4'-(hexahydro-4,7-methanoindane-5-iridine)-diphenylene carbonate] |
| 30 | poly[4,4'-isopropylidenediphenylene carbonate-block-oxytetramethylene) |

Figure 1:
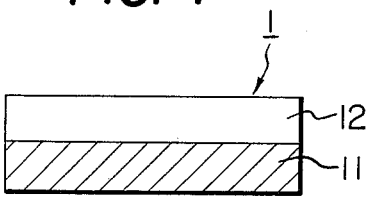
FIGS. 1 through 5 are sectional views of five embodiments of exemplary photosensitive elements prepared according to the method of this invention.
Figure 2:
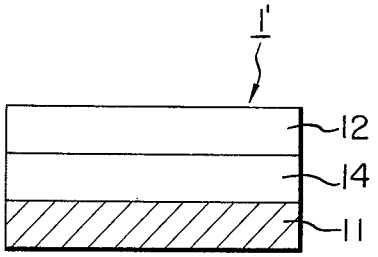

The preparation of the monolayer type photosensitive element illustrated in FIG. 1 by the actual practice of the present method can be achieved by forming a photosensitive solution by dissolving said pyrylium dye and electric insulating polymer in a suitable solvent, such as toluene, tetrahydrofuran, 1,2-dichloroethane, methylene chloride, benzene, methanol or the like; coating this solution on a conducting substrate 11 by means of a wire bar, doctor blade or the like and drying at a temperature of from 40° C. to 110° C. to thereby form a photoconductive layer (co-crystalline complex photosensitive layer) having a thickness of from 5 μm to 15 μm; and then coating the resulting layer likewise with the same solution to form an additional photoconductive layer of said co-crystalline complex thereon, eventually resulting in a co-crystalline complex photosensitive layer 12 having a total thickness of from 15 μm to 50 μm. The respective coating and drying steps of said co-crystalline complex photosensitive solution are limited to two times because more than three overcoats are permissible.

While the aforesaid coating and drying steps are in progress, there is formed a co-crystalline complex with the co-operation of the pyrylium dye and the electric insulating polymer. The ratio of the electric insulating polymer to the pyrylium dye contained in the co-crystalline complex photosensitive layer 12 suitably is 5–20 to 1 in terms of parts by weight. In the formation of this layer 12, a binder may be used as occasion demands.

The conditions for formation of the aforesaid co-crystalline complex photosensitive layer 12 are applicable to the formation of co-crystalline complex photosensitive layer 12 in the composite photosensitive elements illustrated in FIGS. 2 through 5.

As the binder materials used herein, there can be enumerated polyethylene, polystyrene, polybutadiene, styrene-butadiene copolymers, polymers and copolymers of acrylic esters or methacrylic esters, polyester, polyamide, epoxy resin, urethane resin, silicone resin, alkyd resin, cellulosic resins and poly-N-vinylcarbazole and derivatives thereof (for instance, those having halogens such as chlorine and bromine and substituted radicals such as methyl, amino and the like in the carbazole skeleton), polyvinylpyrene, polyvinylanthracene, pyrene-formaldehyde condensation polymers and derivatives thereof (for instance, those having halogens such as bromine and the like and substituted radicals such as nitro and the like in the pyrene skeleton), poly-γ-carbazolyl ethyl-L-glutamates, styrol resin, chlorinated polyethylene, acetal resin, melamine resin and the like. The amount of the binder to be compounded suitably is to be 0.5 parts by weight per part by weight of the co-crystalline composition (pyrylium dye plus electric insulating resin).

This binder may be used in conjunction with plasticizers. The plasticizers utilized widely for resins, for instance, like, dibutyl phthalate, dioctyl phthalate and the like can be utilized in this invention. They are preferred to be used in amounts ranging from about 0 to 30 wt.% against the binder resin employed.

The multilayer type photosensitive element illustrated in FIG. 2 comprises providing, between the co-crystalline complex photosensitive layer 12 and the conducting substrate 11, another photoconductive layer 14 (a photoconductive layer other than the co-crystalline complex photosensitive layer). The materials for making said another photoconductive layer 14 include, in addition to Se, Se-Te, Se-As, etc., an inorganic trigonal system Se and the like dispersed in a binder and those dispersed in the binder colored photoconductive organic pigment particles dispersed in a binder, for instance, phthalocyanine pigments such as copper phthalocyanine and the like; azo pigments such as Sudan Red, Dian Blue, Genus Green B and the like; quinone pigments such as pyrenequinone, Indanthrene Brilliant Violet RRP and the like; indigo pigments such as indigo, thioindigo and the like; bisbenzimidazole pigments suh as Indo Fast Orange Toner and the like; quinacridone pigments, etc. Accordingly, this photoconductive layer 14 is formed on the conducting substrate 11 by means of vacuum evaporation or coating.

The thickness of the photosensitive layer othe than the co-crystalline complex photosensitive layer (photoconductive layer) 14 is about from 10 μm to 50 μm, and in the case where a binder is needed there may be employed the same binder as enumerated with reference to the co-crystalline complex layer 12. In this context, it is to be noted that in the formation of the co-crystalline complex photosensitive layer 12 it is necessary to select such a solvent that the photoconductive layer 14 does not undergo any changes by the action of the solvent thus selected. And, this is applicable to the relation between the photosensitive element 1''' illustrated in FIG. 4 and its intermediate layer 13 in the preparation of the aforesaid element.

FIG. 3 illustrates one example of the photosensitive element 1'' which comprises the conducting substrate 11, the co-crystalline complex photosensitive layer 12 superposed thereon as the first photoconductive layer, and the photoconductive layer 14 other than the co-crystalline complex photosensitive layer superposed further thereon as the second photoconductive layer. Hereupon, attention must be paid to the fact that when a solvent is utilized for the formation of the photoconductive layer 14, it is necessary to select a solvent such that the co-crystalline complex photosensitive layer 12 does not undergo any changes by the action of the solvent thus selected. And, this holds true as to the relation between the photosensitive element 1'''' illustrated in FIG. 5 and its intermediate layer 13 in the preparation of the aforesaid element.

In the cases of the composite photosensitive elements (1', 1'') illustrated in FIGS. 2 and 3, if needed, it is possible to provide an intermediate layer 13, as shown in FIGS. 4 and 5, between the two photoconductive layers 12, 14 constituting the photosensitive layers of each element. This intermediate layer 13 effectively acts to prevent the leakage of electric charge, the suitable thickness being from about 1 μm to 5 μm.

In the formation of said intermediate layer 13 there can be employed the aforesaid binder materials. In addition thereto, cellulose resins such as acetylcellulose, polyamide resins, polyimide resins, etc. can be employed effectively for that purpose. The intermediate layer 13 may be formed by means of the resin dispersion method, and additionally by treating a white or transparent high resistance inorganic compound such as $SiO_2$, $Al_2O_3$, MgO, $MgF_2$ or the like by means of solvent coating, vacuum evaporation, sputtering or the like. If the use of a solvent is indispensable for the formation of said intermediate layer 13, as previously stated, it will be necessary to avoid use of a solvent that is liable to exert changes on the first photoconductive layer.

As described above, the method according to this invention is characterized in that the co-crystalline complex photosensitive layer is provided on the substrate by means of at least two overcoating and drying steps. According to the present method there can be obtained an electrophotographic photosensitive element capable of exhibiting excellent image characteristics, because this method is devised so as not to produce any surface roughness especially when a film is formed which has a thickness of from 20 μm to 30 μm or more, thereby to obtain a superior film. The reason why the satisfactory layer surfaces can be obtained by practicing the present method has not been minutely investigated yet. However, it is considered attributable to the fact that the layer is formed in a thickness which is not extremely thick and therefore can obviate obstacles in course of the film formation step.

The monolayer type photosensitive element (the photosensitive element 1) prepared according to the present method makes it possible to obtain a copied image normally by means of the Carlson process, while the composite photosensitive elements (1', 1'', 1''' and 1'''') illustrated in FIGS. 2 and 5 make it possible to obtain a dichromatic copied image readily by only one imagewise exposure.

In order that the dichromatic copied image may be obtained by only one imagewise exposure as described above, however, as revealed, for instance, in Japanese Laid-open Patent Application No. 112634/1979, etc., it is necessary that these composite photosensitive elements should each be so designed that the second photoconductive layer has a sensitivity to a part of the chromatic light in the visible light region [which will be called (Light B) for convenience' sake] and is capable of transmitting the other chromatic light [which will be called (Light A) for convenience' sake] and the first photoconductive layer has a sensitivity to at least Light A. Such properties can be imparted to the composite photosensitive elements by selecting suitable photoconductive materials, or by selecting suitable conventional coloring agents (dyes or pigments) or suitable sensitizing agents and adding, and further by compounding the intermediate layer 13 with a coloring agent so that said layer may exhibit a filtering effect.

The method of forming a dichromatic image can be carried out by any one of the following processes I, II and III.

In this context, it is to be noted that although these processes are explained with reference to the photosensitive element as illustrated in FIG. 2, these processes are also applicable to the photosensitive elements illustrated in FIGS. 3 through 5 provided that the two photoconductive layers thereof possess the properties described above.

Process-I

The photosensitive element applicable to this process is required to comprise the first photoconductive layer (namely, the photoconductive layer other than the co-crystalline complex photosensitive layer) 14 which has a sensitivity to Light A and the second photoconductive layer (namely, the co-crystalline complex photosensitive layer) 12 which is capable of transmitting Light A as well as has a sensitivity to Light B.

The photosensitive element disposed as aforesaid is first subjected to the positive or negative first corona electrification with a polarity opposite to that to which the first photoconductive layer 14 has a sensitivity or with a polarity opposite to that of a charge to be injected from the substrate 11 to the first photoconductive layer 14, and thereafter is uniformly exposed to Light A alone or a light containing Light A but not Light B. This uniform exposure may be carried out simultaneously with the first electrification, but in case where the first photoconductive layer 14 is disposed to accept a charge injected from the substrate 11 at the time of said first electrification, namely in the case where the first photoconductive layer (14) has a rectification ability, the first electrification may be effected in the dark, dispensing with the step of uniform exposure (FIG. 6-(*a*)).

Next, the light image of the original 2 subjected to the second corona electrification with a polarity opposite to that employed in the first electrification (FIG. 6-(*b*)) is imparted to this photosensitive element. In this case, the second electrification is carried out with an electric potential somewhat lower than that employed in the first electrification. At this time, the portion of the photosensitive element corresponding to the black area of the original 2 does not undergo any change in respect of the charge distribution but the charge distribution at the portion of the photosensitive element corresponding to the white area of the original is so changed that both the first and second photoconductive layers 14, 12 are rendered conductive, whereby the charge present thereat dissipates. On the other hand, at the portion of the photosensitive material corresponding to the chromatic area of the original 2, for instance, Color A area, although the first photoconductive layer 14 is rendered conductive, a part of the charge remains on the second photosensitive layer FIG. 6-(*c*)).

Figure 7:
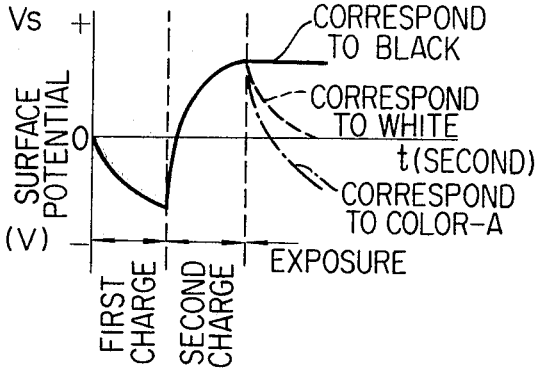

Thus, on each of the photoconductive layers 14, 12 of the photosensitive element are formed electrostatic latent images which correspond to the black and chromatic areas of the original 2 and have a polarity different from each other. These latent images are successively developed with chromatic toner 31 and black toner 32, whereby there is obtained a dichromatic copy (FIG. 6-(*d*)). In this connection, it is to be noted that FIG. 7 illustrates the conditions of surface potential of the photosensitive element with the lapse of time.

In this context, it is to be noted that although the polarity of the first electrification was defined as negative and that of the second electrification was defined as positive, the same results may be obtained if the charge polarity the inverse.

Process-II

The photosensitive element applicable to this process is required to comprise the first photoconductive layer 14 which has a sensitivity to Light B and the second photoconductive layer which is capable of transmitting Light B as well as has a sensitivity to Light A.

The photosensitive element disposed as aforesaid is subjected to positive or negative first corona electrification with the same polarity as that to which the second photoconductive layer 12 exhibits a sensitivity. At this time, the uniform exposure for rendering the second photoconductive layer 12 conductive with Light A is carried out simultaneously with or just after the practice of electrification. In the case where the second photoconductive layer 12 has an ability of transferring the charge at the time of the first electrification, however, the first electrification may be effected in the dark, dispensing with the step of uniform exposure (FIG. 8-(*a*)).

Next, the photosensitive element is subjected to the second corona electrification with a polarity opposite to that employed in the first electrification (FIG. 8-(*b*)), and thereafter the light image of the original is imparted to this photosensitive element. In this case, the second electrification is effected with an electric potential somewhat lower than that employed in the first electrification. At this time, the portion of the photosensitive element corresponding to the black area of the original 2 does not undergo any change in respect of the charge distribution but the charge distribution at the portion of the photosensitive element corresponding to the white area of the original changes to thereby render both the first and second photoconductive layers 14, 12 conductive, whereby the charge present thereat dissipates. On the other hand, at the portion of the photosensitive element corresponding to the chromatic area of the original 2, for instance, Color A area, although the second photoconductive layer 12 is rendered conductive, a part of the charge remains on the first photoconductive layer (FIG. 8-(*c*)).

Figure 9:
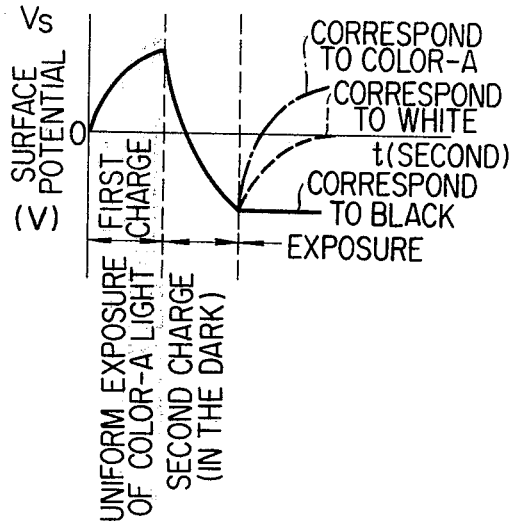
Figure 8A:
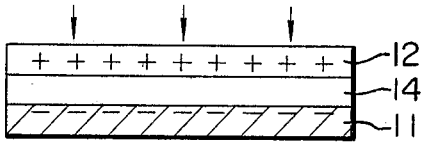
Figure 8B:
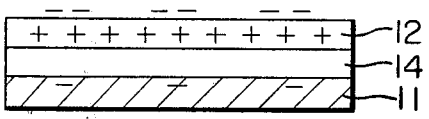
Figure 8C:
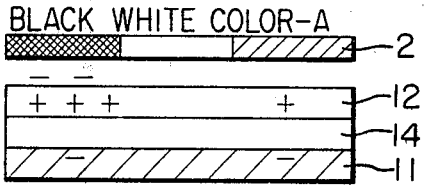
Figure 8D:
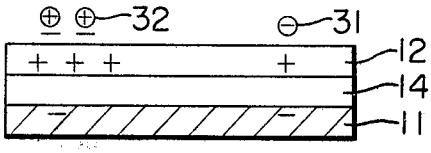
Figure 10A:
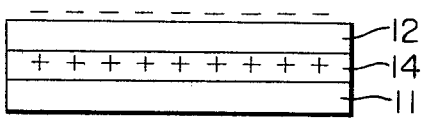
Figure 10B:
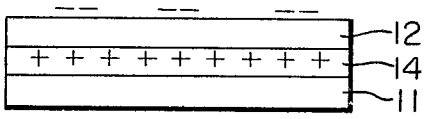
Figure 10C:
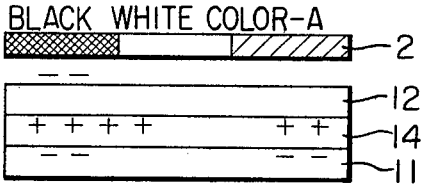
Figure 10D:
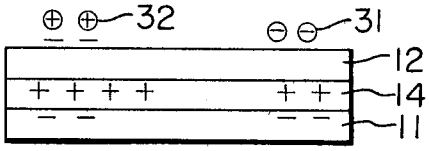

On the photosensitive element are thus formed electrostatic latent images which correspond to the black and chromatic areas of the original 2 and have a polarity different from each other. These latent images are successively developed with chromatic toner 31 and black toner 32, whereby there is obtained a dichromatic copy (FIG. 8-(*d*)). According to this process there can be obtained such an advantage that the black image area takes the form of an external latent image, in other words, latent image formed on the second photoconductive layer. In this connection, it is to be noted that FIG. 9 illustrates the conditions of surface potential of the photosensitive element with the lapse of time throughout this process.

Process-III

The photosensitive element applicable to this process is required to comprise the first photoconductive layer 14 which has a sensitivity to Light B as well as is devised to accept the injection of charge to one charge polarity at the practice of electrification, and the second photoconductive layer 12 which is capable of transmitting Light B as well as has a sensitivity to Light A.

The thus devised photosensitive element is subjected to the first corona electrification in the dark with a polarity opposite to that of a charge to be injected from the substrate 11 to the first photoconductive layer 14 and to which the second photoconductive layer 12 exhibits a sensitivity (FIG. 10-(*a*)).

Figure 11:
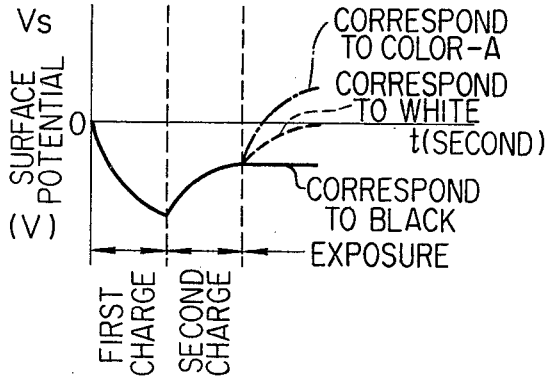

Next, the photosensitive element is subjected to the second corona electrification with a polarity opposite to that employed in the first electrification (FIG. 10-(*b*)), and thereafter the light image of the original 2 is imparted to this photosensitive element. In this case, the second electrification is effected with an electric potential somewhat lower than that employed in the first electrification. At this time, the portion of the photosensitive element corresponding to the black area of the original 2 does not undergo any change in respect of the charge distribution but the charge distribution at the portion of the photosensitive element corresponding to the white area of the original changes so that both the first and second photoconductive layers 14, 12 are rendered conductive, whereby the charge present thereat dissipates. On the other hand, at the portion of the photosensitive element corresponding to the chromatic area of the original 2, for instance, Color A area, although the second photoconductive layer 12 is rendered conductive, there remains a part of the charge on the first photoconductive layer (FIG. 10-(*c*)). Thus, on the photosensitive element there are formed electrostatic latent images which correspond to the black and chromatic areas of the original and have a different polarity respectively. These latent images are developed successively with chromatic toner 31 and black toner 32 thereby to obtain a dichromatic copy (FIG. 10-(*d*)). This process is advantageous in that the black image area takes the form of external latent image. In this connection, it is to be noted that FIG. 11 illustrates the conditions of surface potential of the photosensitive element with the lapse of time throughout this process.

In the aforegoing explanation the polarity of the first electrification is negative and that of the second electrification is positive. However, it is to be understood that even when the charge polarity is inverted, if the conditions are satisfied, there may be obtained the same results.

In addition, the present composite photosensitive elements illustrated in FIGS. 2 through 5 are applicable to not only aforesaid Processes I, II and III, but also, the conventional Carlson process. Still further, the original used in the present method should not be limited only to the dichromatic original as revealed in the aforesaid embodiments but includes multi-color ones such as trichromatic or more. When such a multi-color original is applied to the above-mentioned dichromatic reproduction process for copying purposes there can be obtained a dichromatic copy, although a shade of color is perceived between the respective chromatic areas. On the other hand, when this multi-color original is applied to the Carlson process (monochromatic reproduction) there can be obtained a white and black image-carrying copy with a marked difference in the image density between the respective chromatic areas.

DESCRIPTION OF THE PREFERRED EMBODIMENTS

Example 1

| | |
|---|---|
| p-dimethylaminophenyl-2,6-diphenylthiapyrylium perchlorate | 1 g |
| 4,4'-bis(diethylamino)-2,2'-dimethyltriphenyl methane | 21 g |
| polycarbonate (Panlite K-1300, available from TEIJIN K.K.) | 28 g |
| methylene dichloride | 700 ml |

A photosensitive solution comprising the above composition was coated on an Al evaporation-coated polyester film by means a doctor blade, and dried at 80° C.

for 5 minutes to thereby form a co-crystalline complex photosensitive layer having a thickness of about 10 μm. The photosensitive solution comprising the same composition as mentioned above was again coated on said photosensitive layer and dried under the exactly same conditions, whereby there was obtained an electrophotographic photosensitive element (Our element 1) with a co-crystalline complex photosensitive layer having a total thickness of about 20 μm.

On the other hand, the photosensitive solution comprising the same composition as mentioned above was coated only once on an Al evaporation-coated polyester film by means of a doctor blade and dried at 80° C. for 10 minutes to thereby form a co-crystalline complex photosensitive layer having a thickness of about 19 μm, whereby there was obtained a photosensitive element (Control 1).

Furthermore, a 0.45% dichloromethane solution of p-dimethylaminophenyl-2,6-diphenylthiapyrylium perchlorate was coated on the photosensitive layer of Control 1, and an overcoat layer, in which a dye is present in an amount of about 130 mg/m$^2$, is further superposed on said photosensitive layer, whereby there was obtained a photosensitive element (Control 2).

These photosensitive elements were subjected to −6 KV or +6 KV corona electrification in the dark by means of a paper analyzer manufactured by KAWAGUTI DENKI K.K., and then exposed to irradiation of light of 20 lux for sensitivity measuring purposes. The results thus obtained are as shown in the following table. In the table, $Vc_{20}$ represents the surface potential (V) at the time when 20 seconds passed after the start of corona electrification, $Vd_{20}$ represents the surface potential (V) at the time when the element was left stand in the dark for 20 seconds after the completion of said corona electrification, and E1/10 represents the exposure amount (lux.sec.) required until the initial surface potential, upon undergoing irradiation of light, is reduced to 1/10.

| | Charge polarity | $Vc_{20}$ | $Vd_{20}/Vc_{20}$ | E1/10 |
|---|---|---|---|---|
| Our element 1 | minus | 1437 | 0.87 | 5.8 |
| | plus | 1817 | 0.84 | 4.4 |
| Control 1 | minus | 1379 | 0.86 | 8.7 |
| | plus | 1632 | 0.82 | 7.1 |
| Control 2 | minus | 1460 | 0.87 | 12.1 |
| | plus | 1614 | 0.83 | 4.9 |

EXAMPLE 2

Six % by weight of tellurium was doped on an Al substrate and then selenium was vacuum evaporated on said substrate heated to 60° C. in a thickness of about 25 μm, whereby a first photoconductive layer was formed. A novolak resin (cp-918, manufactured by GUNEI KAGAKU K.K.) was coated on the thus formed first photoconductive layer by means of the dipping method to thereby form an intermediate layer having a thickness of about 1 μm. Then, a photosensitive solution comprising the same composition as utilized in Example 1 was coated on this intermediate layer by means of a doctor blade and dried at 50° C. for 10 minutes, thereby obtaining a co-crystalline complex photosensitive layer having a thickness of about 12 μm. The same photosensitive solution was overcoated thereon and dried at 50° C. for 10 minutes to obtain a co-crystalline complex photosensitive layer (a second photoconductive layer) having a total thickness of about 24 μm. Thus, a composite type electrophotographic photosensitive element (Our element 2) was prepared.

For comparison's sake, a composite photosensitive element (Control 3) was prepared according to the exactly same procedure as aforesaid with the exception that the co-crystalline complex photosensitive layer (the second photoconductive layer) was formed by one time coating operation so as to have a thickness of about 24 μm.

The photosensitive element according to this invention (Our element 2) was uniformly exposed to red light through a R-64 filter (manufactured by HOYA GLASS K.K.) simultaneously with a first corona electrification conducted with +6 KV in the dark and thereafter was subjected to a second corona electrification with −5.5 KV. Next, the present photosensitive element was subjected to imagewise exposure by the use of a red and black dichromatic original and the thus treated photosensitive element was developed successively with a red toner and a black toner, whereby there was obtained a clear-cut red and black dichromatic copied image free from background stains.

On the other hand, the control photosensitive element (Control 3) was likewise subjected to the image forming operation to find that a very inferior copied image was obtained because red/black mixed images were produced at unevenly coated portions of the second photoconductive layer and additionally achromatization and background stains took place thereat.

What is claimed is:

1. A method of preparing an electrophotographic element which comprises the steps of: applying onto an electrically conductive substrate, a first overcoating layer of a solution consisting essentially of an organic solvent having dissolved therein a pyrylium dye and an electrically insulating polycarbonate resin containing an alkylidenediarylene group in the recurring units thereof, and then drying said first overcoating layer by evaporating said solvent whereby to form on said substrate a first stratum consisting essentially of a co-crystalline complex of said pyrylium dye and said polycarbonate resin; then, at least once, directly overcoating said first stratum with another overcoating layer of said solution and then drying said another overcoating layer by evaporating said solvent to form another stratum consisting essentially of said complex whereby to obtain a composite photosensitive layer consisting essentially of a plurality of said strata.

2. A method as claimed in claim 1 including the step of forming on said composite photosensitive layer, a second photosensitive layer made of a material different from said co-crystalline complex.

3. A method as claimed in claim 2 including the step of forming an intermediate layer between said composite photosensitive layer and said second photosensitive layer, said intermediate layer being made of a material effective to prevent leakage of electric charge between said composite photosensitive layer and said second photosensitive layer.

4. A method as claimed in claim 2 in which said solution contains from 5 to 20 parts by weight of said polycarbonate resin per 1 part by weight of said pyrylium dye.

5. A method as claimed in claim 2 in which the thickness of each stratum is from 5 to 15 μm and the total thickness of said composite photosensitive layer is from 15 to 50 μm.

6. A method as claimed in claim 2 in which in each drying step, the drying temperature is from 40° to 110° C.

7. A method as claimed in claim 2 in which the solvent is selected from the group consisting of toluene, tetrahydrofuran, 1,2-dichloroethane, methylene chloride, benzene and methanol.

8. A method as claimed in claim 2 in which said solution contains a binder resin in an amount of about 0.5 part by weight per 1 part by weight, based on the sum of the pyrylium dye and the polycarbonate resin.

9. A method of preparing an electrophotographic element which comprises the steps of: applying onto a first photosensitive layer on an electrically conductive substrate, a first overcoating layer of a solution consisting essentially of an organic solvent having dissolved therein a pyrylium dye and an electrically insulating polycarbonate resin containing an alkylidenediarylene group in the recurring units thereof, and then drying said first overcoating layer by evaporating said solvent whereby to form on said first photosensitive layer a first stratum consisting essentially of a co-crystalline complex of said pyrylium dye and said polycarbonate resin; then, at least once, directly overcoating said first stratum with a second overcoating layer of said solution and then drying said second overcoating layer by evaporating said solvent to form a second stratum consisting essentially of said complex whereby to obtain a second composite photosensitive layer consisting essentially of said strata, said first photosensitive layer being made of a photosensitive material different from said co-crystalline complex.

10. A method as claimed in claim 9 including the step of forming an intermediate layer between said first photosensitive layer and said second composite photosensitive layer, said intermediate layer being made of a material effective to prevent leakage of electric charge between said composite photosensitive layer and said first photosensitive layer.

11. A method as claimed in claim 9 in which said solution contains from 5 to 20 parts by weight of said polycarbonate resin per 1 part by weight of said pyrylium dye.

12. A method as claimed in claim 9 in which the thickness of each stratum is from 5 to 15 μm and the total thickness of said composite photosensitive layer is from 15 to 50 μm.

13. A method as claimed in claim 9 in which in each drying step, the drying temperature is from 40° to 110° C.

14. A method as claimed in claim 9 in which the solvent is selected from the group consisting of toluene, tetrahydrofuran, 1,2-dichloroethane, methylene chloride, benzene and methanol.

15. A method as claimed in claim 9 in which said solution contains a binder resin in an amount of about 0.5 part by weight per 1 part by weight, based on the sum of the pyrylium dye and the polycarbonate resin.

* * * * *